United States Patent [19]

Speer

[11] Patent Number: 5,061,517

[45] Date of Patent: Oct. 29, 1991

[54] BRUSH-ON FINISH FOR FOOTWEAR AND SIMILAR ARTICLES

[76] Inventor: Lawrence L. Speer, 400 W. Hopocan, Barberton, Ohio 44203

[21] Appl. No.: 440,081

[22] Filed: Nov. 22, 1989

[51] Int. Cl.[5] ..... B32B 35/00

[52] U.S. Cl. ..... 427/140; 427/322; 427/323; 427/389; 427/429

[58] Field of Search ..... 427/323, 389, 429, 322, 427/140

[56] References Cited

U.S. PATENT DOCUMENTS

| | | | |
|---|---|---|---|
| 3,619,257 | 11/1971 | Fukada et al. | 427/303 |
| 3,887,413 | 6/1975 | Speer | 427/140 |
| 3,958,057 | 5/1976 | Nishimura et al. | 427/203 |
| 3,962,512 | 6/1976 | Fontana et al. | 427/366 |
| 3,975,558 | 8/1976 | Speer | 427/140 |
| 3,987,223 | 10/1976 | Wagner et al. | 427/389 |
| 4,544,578 | 10/1985 | Duane | 427/140 |
| 4,810,251 | 3/1989 | Träubel et al. | 427/389 |
| 4,948,443 | 8/1990 | Speer | 427/140 |

*Primary Examiner*—Janyce Bell

*Attorney, Agent, or Firm*—Cushman, Darby & Cushman

[57] ABSTRACT

An item of footwear which has become scuffed or worn, or which is to be protected against wear, on its leather or leather-like external surfaces, is subjected to a preliminary cleaning. Thereafter, a coating of polyurethane elastomer dissolved in a solvent (preferably half toluene and half isopropyl alcohol), further including a colorant, a thickener and a gloss-lowering agent, is brushed or swabbed onto the surface. The solvent evaporates, leaving a thin, flexible, scuff-resistant coating the color of which covers and hides discoloration and scuffs on the original surface.

4 Claims, No Drawings

BRUSH-ON FINISH FOR FOOTWEAR AND SIMILAR ARTICLES

BACKGROUND OF THE INVENTION

For the consumer and professional, there has been a variety of products available throughout the years for the recoloring of footwear. Aerosol, lacquer-type sprays, and brush-on recolor water-based type finishes have been on the market for a considerable time. These products have had inherent deficiencies. The fast-dry lacquer-type aerosols, or sprays, mostly become hard after they are applied, because the nature of the coating is a solvent-type lacquer, which has been manufactured by dissolving a resin into a solvent. The resulting coating, then, has the properties of the resin-solvent blend. If the resulting coating would be too hard, plasticizer is often added as an external agent to soften the resulting coating. What then happens is that the plasticizer migrates out of the coating, making it hard and brittle. Or, while in the coating, the plasticizer may render the surface tacky. That is the nature of plasticizers. Lacquer-type coatings, whether nitrocellulose, vinyl, or acrylic, do not have the requisite inherent flexibility. Therefore, coatings conventionally are mixtures of chemicals. The resulting coating can exhibit different qualities as it ages. There often is a considerable loss of flexibility, wear, abrasion resistance, etc. As a result, known recolor finishes for shoes, whether they be solvent blends or water-based blends, exhibit qualities of serious aging and deterioration because of the nature of how the coating was manufactured. Thus, a shoe recoloring product loses its washability, durability, and flexibility, because the mixed chemicals do not stay in the condition they were, at the time of mixing.

Almost all new sneakers soon get dirty, and show signs of wear and tear after they are used in sports activities. The same is true for most shoes and footwear. It is not uncommon for sneakers and shoes to show considerable signs of use and wear shortly after being purchased.

One popular product on the market now is a water-based color coating for ladies shoes. It has very poor water resistance and does not wear well. It is a color coating which is a mixed-together product. Professionals also have available a lacquer-type aerosol which colors shoes and leather, but exhibits the same poor tendencies of all mixed coatings and finishes.

There are similar problems in protecting luggage and other leather and leather-like goods that, like footwear, are subject to scuffing, flexing and changes in humidity, since the finishes available to recolor and protect them are generally the same as those available for recoloring and protecting the outer surfaces of leather and leather-like portions of footwear.

SUMMARY OF THE INVENTION

An item of footwear which has become scuffed or worn, or which is to be protected against wear, on its leather or leather-like external surfaces, is subjected to a preliminary cleaning. Thereafter, a coating of polyurethane elastomer dissolved in a solvent (preferably half toluene and half isopropyl alcohol), further including a colorant, a thickener and a gloss-lowering agent, is brushed or swabbed onto the surface. The solvent evaporates, leaving a thin, flexible, scuff-resistant coating the color of which covers and hides discoloration and scuffs on the original surface.

DETAILED DESCRIPTION

The surfaces that can be recolored and/or protected using the process and coating material of the present invention are generally the external surfaces, subject to wear and discoloration, of leather and leather-like footwear such as one would ordinarily think to protect using shoe polish, leather protector, vinyl protector and the like.

In addition to leather (tanned animal skin), the following are examples of leather-like materials which can be protected using the method and coating material of the present invention: sneakers, tennis shoes, all types of men's and ladies' footwear, athletic shoes and equipment, belts, briefcases and other leather goods, as well as those made of synthetic or artificial leather, typically polyvinylchloride.

An initial step in practicing the method of the invention is cleaning the surface which is to be coated. The surface may be cleaned by applying a cleaning agent, and then wiping the surface. More than one cleaning agent can be used in succession or mixed together, and any convenient means may be used for applying the cleaning agent then wiping the surface, e.g. spraying, swabbing, dipping, followed by wiping with a cloth, sponge, squeegee or the like.

The preferred cleaning agent is acetone. In addition, the following are examples of cleaning agents which can be used: ethyl acetate, isopropyl alcohol, methyl ethyl ketone and methylisobutyl ketone.

The coating composition used in the present invention includes a reacted polyurethane elastomer, dissolved in a solvent, a pigmented colorant, a thickener and, preferably, a gloss-lowering agent.

The preferred polyurethane elastomer is Spencer Kellogg Products/NL Chemicals Spenlite L89-30S (product code No. 38489) which is believed to be 30% reacted polyurethane elastomer dissolved in 35% toluene and 35% isopropyl alcohol.

The preferred polyurethane elastomer is believed to be a type 5 thermoplastic polyester-type polyurethane elastomer. In addition to the preferred elastomer, the following are examples of polyurethane elastomer which could be used as the polyurethane ingredient of the coating composition of the present invention: QC10 available from K. J. Quinn & Co. of Malden, Mass., and Desmolac 4125, available from Mobay Chemical Corp. of Pittsburgh, Pa.

The preferred solvent for the polyurethane elastomer is a 1:1 mixture of toluene and isopropyl alcohol (which is the same solvent system used by the manufacturer in Spenlite L89-30S). Examples of other solvents which could be used include: methyl ethyl ketone and/or isobutyl ketone mixed with isopropyl alcohol.

Except where the coating is to be used as a clear protective coating on a non-worn surface, the coating composition includes a pigmented colorant. Examples of pigmented colorants which could be used include: thalo blue and titanium dioxide. Pigments must be ground into the resin, not mixed in, as is the case with a typical resin formulation.

(The preference of colorant is dictated by the desired color of the resulting coating.)

By preference, the coating composition further includes a thickener, in order to help keep the pigment evenly dispersed throughout the coating composition.

The preferred thickener is Nuodex Nuvis HS, which is believed to consist of acid agents coated with powder which chemically cause a reaction which thickens the coating. Examples of other thickeners which could be used include: lecithin.

By preference, except where the coating is meant to provide the coated surface with a patent leather-like shiny appearance, the coating composition further includes a gloss-reducing agent. A preferred gloss-reducing agent is Syloid, made by The Syloid Company, which is believed to consist of: powdered silica which reduces the gloss levels of paints and coatings. Examples of other gloss-reducing agents which could be used are: other powdered silicas, micron size.

A specific example of a coating composition which is preferred for use in practicing the present invention is as follows:

| Parts by Weight | Ingredient |
|---|---|
| 1 | Spenlite L89-30S |
| 1.5 | solvent (1:1 toluene and isopropyl alcohol) |
| 10 | pigment |
| 1 | Nuvis HS thickener |
| 1 | Sylox gloss-lowering agent |

The ingredients may vary in percentage from the point values given above in the specific example of the preferred embodiment. In fact, the ingredients may vary as follows:

| Range of weight percent | Ingredient |
|---|---|
| 20% to 40% | polyurethane elastomer |
| 40% to 60% | solvent |
| 10% to 20% | pigment |
| 1% to 3% | thickener |
| 1% to 2% | gloss-lowering agent |

The coating composition is preferably applied by using a conventional brush, sponge, swab, wiper or the like to spread on a thin coating, which is preferably allowed to air dry at room temperature.

The coating is preferably applied so thinly that one ounce of the coating composition covers from 10 to 25 square inches of the surface of the leather or leather-like substrate.

The coating composition optionally may include additional ingredients for their respective qualities. Examples of such other possible ingredients, and the range of weight percentages that each may have in the coating composition are: lethicin, 1–3 percent, to improve gloss, slow drying time and increase pigment dispersion; N-methyl perrillidone to slow drying time of the lacquer; other slow solvents such as cellusolve acetate and/or xylene, may be used to slow down drying time.

It should now be apparent that the brush-on finish for footwear and similar articles as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A method for recoloring a consumer article such as a shoe, on a discolored and scuffed or worn external leather or leather-like surface of the article, comprising:

(a) providing a consumer article having a discolored and scuffed or worn external leather or leather-like surface;

(b) cleaning said surface by applying a cleaning agent thereto, followed by wiping said surface;

(c) applying onto said discolored and scuffed or worn surface, after cleaning in step (b), a coating composition comprising polyester-type polyurethane elastomer dissolved in a solvent further including a pigmented colorant, so as to cover over and thereby recolor discolorations on said surface; and (d) permitting said coating to dry.

2. The method of claim 1, wherein:

the coating composition further comprises a gloss-reducing agent.

3. The method of claim 1, wherein:

the solvent is a mixture of toluene and isopropyl alcohol.

4. The method of claim 1, wherein:

said surface is the surface of a shoe.

* * * * *